US006379608B1

(12) United States Patent
Enkner et al.

(10) Patent No.: US 6,379,608 B1
(45) Date of Patent: Apr. 30, 2002

(54) METHOD FOR CLOSING AND OPENING A TAPPING HOLE OF A METALLURGICAL VESSEL

(75) Inventors: Bernhard Enkner, Linz; Helmut Kerschbaum; Ernst Höllwarth, both of Neuzeug; Albert Paster, Niederkappl; Christian Post, Linz, all of (AT)

(73) Assignee: Voest Alphine Industrieanlagenbau GmbH (AU)

( * ) Notice: Subject to any disclaimer, the term of this patent is extended or adjusted under 35 U.S.C. 154(b) by 0 days.

(21) Appl. No.: 09/574,782

(22) Filed: May 19, 2000

(30) Foreign Application Priority Data

May 21, 1999 (AT) ..... A 908/99

(51) Int. Cl.[7] ..... C21B 7/12
(52) U.S. Cl. ..... 266/45; 266/271; 222/599
(58) Field of Search ..... 266/45, 271, 272; 222/597, 598, 599

(56) References Cited

U.S. PATENT DOCUMENTS 4,079,918 A * 3/1978 Truppe et al. ..... 266/45
4,232,855 A * 11/1980 Hartl ..... 266/272
4,261,554 A * 4/1981 Eysn ..... 266/272
4,382,582 A * 5/1983 Seki ..... 266/45
4,875,663 A * 10/1989 Forestier ..... 266/272

FOREIGN PATENT DOCUMENTS

| | | |
|---|---|---|
| AT | 0350090 | 5/1979 |
| DE | 3208490 | 11/1983 |

* cited by examiner

*Primary Examiner*—Scott Kastler
(74) *Attorney, Agent, or Firm*—Ostrolenk, Faber, Gerb & Soffen, LLP

(57) ABSTRACT

In a method for closing and opening a tapping hole of a metallurgical vessel, in which method a closure body (4), which leaves clear an annular gap between the closure body (4) and the wall of the tapping hole, can be moved out of a waiting position (I) into a closure position (II), in which it covers the tapping hole, and back, and in which method, at least in the closure position (II), a pressurized gas is introduced into the tapping hole counter to the outflow direction of a molten material contained in the metallurgical vessel, in order to avoid skull formation, the closure body (4) is moved out of the waiting position (I) into the closure position (II) and back with directions of movement which lie in different areas.

13 Claims, 6 Drawing Sheets

50°
10°
A
B
C
D
B'
C'
D'
A'

METHOD FOR CLOSING AND OPENING A TAPPING HOLE OF A METALLURGICAL VESSEL

The invention relates to a method for closing and opening a tapping hole of a metallurgical vessel, in particular a steelworks converter, in which method a closure body, which leaves clear an annular gap between the closure body and the wall of the tapping hole, can be moved out of a waiting position into a closure position, in which it covers the tapping hole, and back, and in which method, at least in the closure position, a pressurized gas is introduced into the tapping hole counter to the outflow direction of a molten material contained in the metallurgical vessel, and to a device for carrying out the method.

A method of this type and an arrangement for carrying out the method are known from DE 32 08 490 C and from AT 350 090 B.

In order for the molten steel to be tapped, oxygen-blowing steelworks converters have a dedicated tapping port which is arranged well below the converter mouth. When the converter is tilted into the tapping position, it is firstly slag which flows out of this tapping hole, known as first or flush slag, followed by steel, the vortex effect meaning that a certain quantity of slag—known as entrained slag—is carried with this steel, and finally, when there is no more steel in the converter, there follows bottoms slag until the converter is tilted back.

When pig iron is being refined to form steel, oxidation reactions result in undesirable accompanying elements from the molten iron which have an affinity for oxygen being bonded to oxygen, and the oxides formed are emitted in gas form or are transferred into the slag. After refining, a large number of elements for deoxidation and alloying purposes have to be added to the steel, and these elements have a higher affinity for oxygen then the undesirable accompanying elements which are trapped in the slag. Consequently, such alloying elements can reduce the undesirable accompanying elements from the slag, and themselves become part of the slag. Moreover, refining slags may be highly aggressive with regard to the refractory material of the melting vessel and casting ladle. Therefore, for quality reasons and for reasons of economy, it is desired to as far as possible prevent slag from being entrained during tapping and alloying of a molten material in the ladle.

That the slag be held back during the tapping operation from the oxygen-blowing steelworks converter is—as explained above—a demand imposed on the metallurgist: the molten steel is tapped from the converter into the steel casting ladle via the tapping hole, and entrained slag floats on the molten steel in the ladle and has an adverse effect on the quality of the steel.

Methods and devices of the type described in the introduction have proven themselves in practice. The closure body leaves clear an annular gap with respect to the wall of the tapping hole, through which gap air is sucked into the interior of the metallurgical vessel by dint of the pressurized gas which is fed through the closure body and is blown into the tapping hole. As a result, the molten material inside the vessel is prevented from flowing out and the tapping hole is completely sealed by pneumatic means. A device of this nature is able to hold back approximately 50% of the total slag in the converter. 20% of the total slag flows out as first or flush slag. 30% of the total slag is formed by the entrained slag—known as the vortex—which runs out during tapping and cannot be influenced by any device.

The opening and closing of the tapping hole using one of the devices described above have proven useful in practice, but the following drawback does arise: with the known devices, the transition from slag discharge to steel discharge is monitored by means of a ratio pyrometer which, when the tapped material changes from steel to slag or from slag to steel, emits a pulse which is used to pivot the closure body inwards and outwards in order to close or open the tapping hole. The problem lies in the clarity of the signal. When a pressurized gas, such as for example nitrogen, is being blown in order to hold back slag, the tapping hole itself is blown clear. If steel then also reaches the inner opening of the tapping hole, it will penetrate into the tapping hole, since it is heavier. It is initially mixed with slag, resulting in an extremely turbulent state. However, the jet itself will initially still be held back by the pressurized gas. Consequently, above a certain bath level above the tapping hole, the increasing pressure of the molten steel will suddenly result in a reversal of this state, which is becoming ever more labile, until a rush of liquid steel pours into the tapping hole. The signal receiver will then respond, but it is impossible to prevent some of this quantity from pouring out before the closure body has been removed from the tapping hole. Steel is already flowing through the tapping hole onto the closure body before the tapping hole has been fully opened. The amount of steel which flows out is of the order of magnitude of 120 to 250 kg of steel, depending on the state of the tapping hole. This quantity pours over the closure device, thus imposing extremely high loads on the latter and causing skull formation.

Even if the pivoting movement of the closure body in the known devices is initiated as soon as the emergence of steel is detected, the closure body still moves a relatively long distance in the direction of the longitudinal axis of the tapping hole, so that even if the pivoting movement is carried out rapidly considerable skull formation on the closure body results. Only while there is no steel entrained with the jet flowing out of the tapping hole is there no risk of skull formation on the device, i.e. of material being deposited on the device. After it has cooled, solidified slag falls off relatively easily and scarcely inhibits the mobility of the device.

The invention aims to avoid the drawbacks and difficulties of the prior art and is based on the object of providing a method and a device for carrying out the method which significantly reduce the risk of skull formation and allow steel to be tapped off with a significantly reduced amount of slag running out.

According to the invention, this object is achieved, in a method of the type described in the introduction, by the fact that the closure body is moved out of the waiting position into the closure position and back with directions of movement which lie in different areas.

Preferably, the closure body, when it is being brought from the waiting position into the closure position, is firstly moved in a direction of movement which has a principal movement component which is approximately transverse with respect to the longitudinal axis of the tapping hole and, just before it reaches the closure position is moved in a direction of movement which has a principal movement component which is approximately in the direction of the longitudinal axis of the tapping hole, and when it is being moved out of the closure position into the waiting position is firstly moved a short distance in a direction of movement with a principal movement component which is approximately in the direction of the longitudinal axis of the tapping hole and is then moved a longer distance in a direction of movement with a principal movement component which is approximately transverse with respect to the direction of the longitudinal axis of the tapping hole. This makes it possible to reduce the movement of the closure body in the area of the jet emerging from the tapping hole to the absolute minimum required.

According to the prior art, to make it possible for a pressurized-gas jet to be introduced into the tapping hole so that ambient air is sucked in, the closure body is moved in a plane in which the longitudinal axis of the tapping hole lies, with the result that the closure body together with its pressurized-gas outlet comes to lie inside the tapping hole. As a result, the movement of the closure body in the area of the jet emerging from the tapping hole lasted a relatively long time, which according to the invention it is possible to avoid.

Expediently, the movement with the principal movement component which is approximately transverse with respect to the longitudinal axis of the tapping hole is implemented over a significantly longer distance than the movement with the principal movement component which is in the direction of the longitudinal axis of the tapping hole, preferably over a distance which is at least five to ten times as long.

A device for closing a tapping hole of a metallurgical vessel, in particular a steelworks converter, in which device a closure body can be brought out of a waiting position into a closure position, in which it covers the tapping hole, and back, leaving clear an annular gap between the closure body and the wall of the tapping hole, by means of a movement device, and in which device the closure body is provided with at least one pressurized-gas outlet, which is connected to a gas-supply line, on its side which, in the closure position, faces towards the tapping hole is characterized in that, with the movement device for bringing the closure body out of the waiting position into the closure position, the closure body can be moved firstly in a direction of movement with a principal movement component which is approximately transverse with respect to the longitudinal axis of the tapping hole and then into the closure position with a principal movement component which is approximately in the direction of the longitudinal axis of the tapping hole.

Preferably, two movement devices are provided, one of which enables the closure body to move with the principal movement component which is approximately transverse to the direction of the longitudinal axis of the tapping hole, and the further movement device enables the closure body to move with a principal movement component which is approximately in the direction of the longitudinal axis of the tapping hole, in which case, advantageously, the movement devices provided are two pivoting devices, the closure body being mounted on an arm which can pivot in two planes which are approximately at right angles to one another.

A device which is characterized in that the movement devices are formed by pressure-medium cylinders, which each act on the arm bearing the closure body by way of a system of levers, has proven particularly robust.

A preferred embodiment is characterized in that the closure body is arranged on an arm which projects from a pivot pin, which pivot pin is mounted pivotably on a rocker shaft which is directed approximately perpendicular thereto, the rocker shaft being mounted rotatably on a holding fixture arranged on the metallurgical vessel, in which case, advantageously, the rotary movement of the rocker shaft extends over approximately 40 to 60°, and the pivoting movement about the pivot pin extends over 5 to 15 °.

A structurally simple solution is characterized in that the pressure-medium cylinder for executing a rotation of the rocker shaft acts, via a lever acting on the rocker shaft, and the pressure-medium cylinder for executing the pivoting movement about the pivot pin acts, via a radially projecting rocker bearing on one end of an arm of an elbow lever, the other arm of which bears the closure body.

BRIEF DESCRIPTION OF THE DRAWINGS

The invention is explained in more detail below with reference to the drawing of an exemplary embodiment, FIG. 1 diagrammatically depicting the area in which, during opening or closure of a tapping-hole closure according to the prior art, the tapping-hole body is in the immediate vicinity of or inside the tapped jet.

It can be seen that the closure body 4, when it is pivoting in from the waiting position I into the closure position II or pivoting out in the opposite direction from the closure position II into the waiting position I, is in the immediate heat-affected vicinity of the tapped jet 1 or is actually in direct contact with the tapped jet 1 over a pivoting angle $\alpha$ of approximately 30°. This configuration results in a long time during the course of which the tapped jet 1 is acting on the closure body 4, and it is impossible to prevent skull formation on this body and on the pivoting arm 5.

Figure 1:
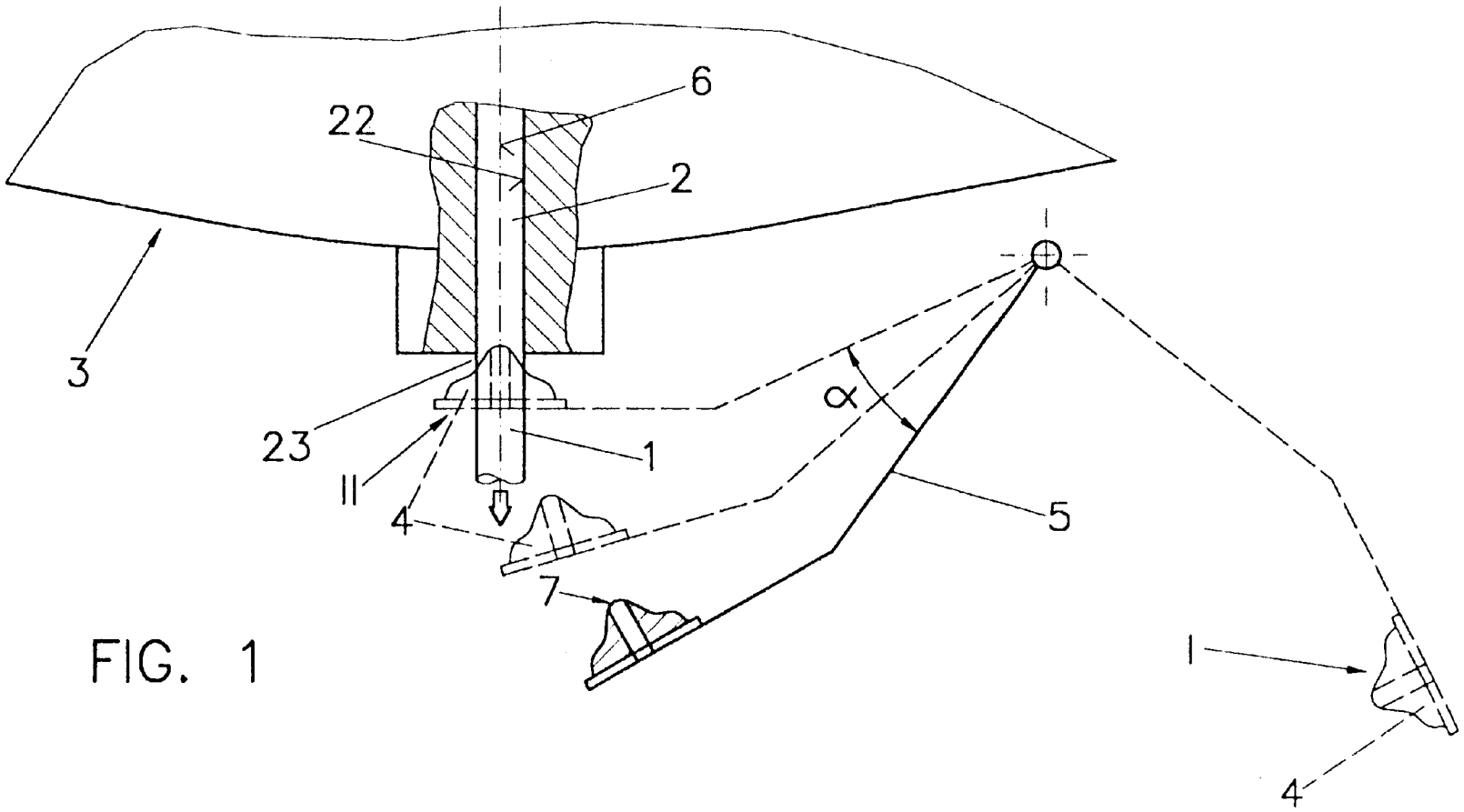
FIG. 1 shows a tapped jet 1 which is emerging from the tapping hole 2 of a converter 3 which is pivotable and, in the view shown in FIG. 1, is pivoted into the tapping position (and of which only the region having the tapping hole is shown). A diagramatically depicted closure body 4, which is attached to a pivoting arm 5, can be pivoted in a plane which lies through the longitudinal axis 6 of the tapping hole 2. On its side which faces towards the tapping hole 2 in the closure position II, the closure body 4 has a pressurized-gas outlet 7, which is connected to a flexible pressurized-gas line (not shown in more detail in the drawing) and through which pressurized gas can be blown through the tapping hole 2 as a retaining medium. The pressurized gas may be activated as early as during the pivoting operation, specifically at a point beyond which the closure body is situated in the vicinity of the tapped jet 1.
Figure 2:
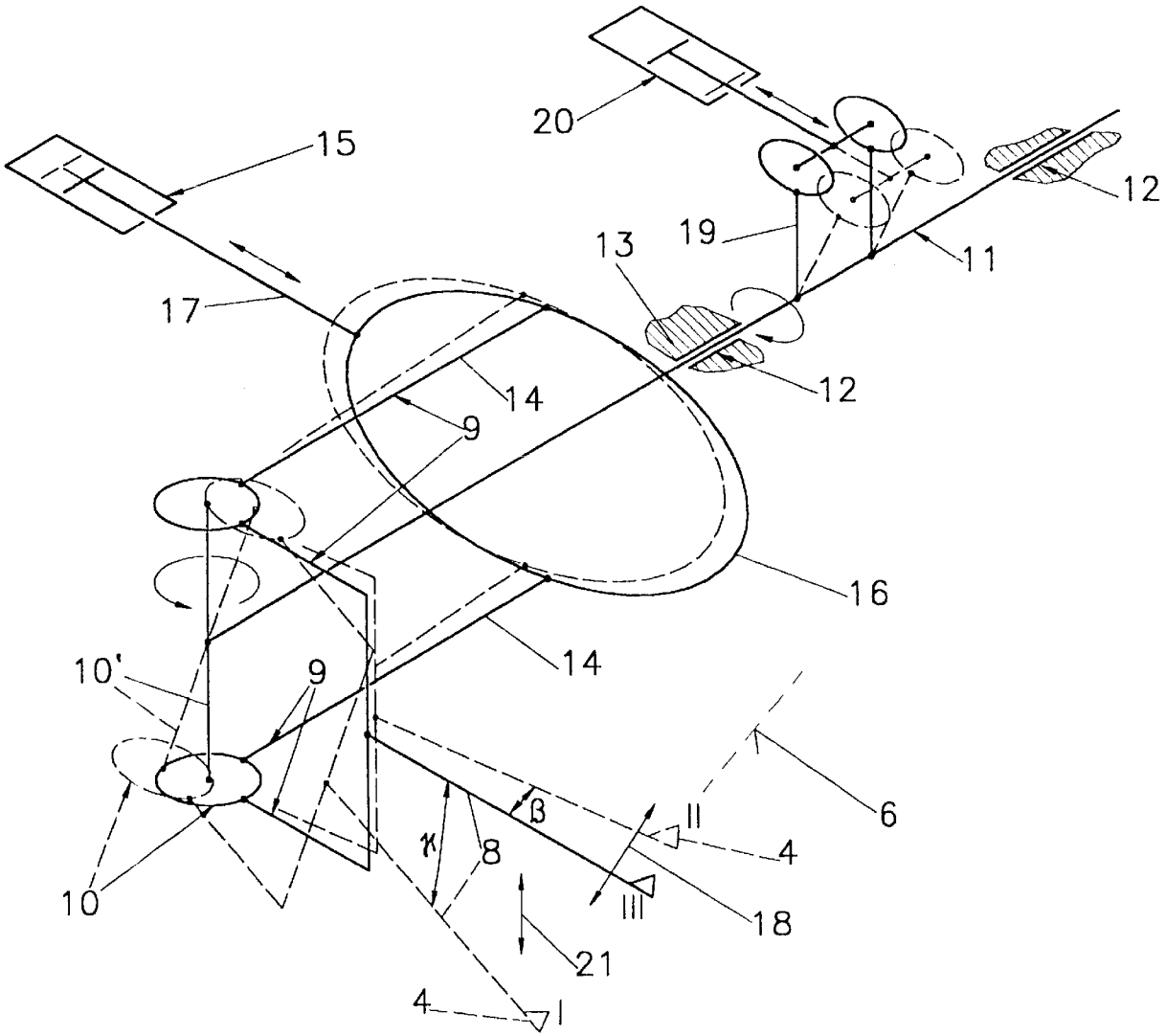
FIG. 2 diagrammatically depicts an outline view of a device of the type according to the invention.

FIG. 2 diagramatically depicts the device according to the invention for carrying out the method according to the invention. The closure body 4 is attached to one arm 8 of a two-armed elbow lever 9 which is mounted pivotably on a rocker shaft 11 via a pivot bearing 10 which forms a pivot pin 10'. Via bearing 12, the rocker shaft 11 is rotatably linked to a holding fixture 13 attached to the metallurgical vessel 3. The second arm 14 of the elbow lever 9 can be pivoted with respect to the rocker shaft 11 by means of a movement device which is designed as a pressure-medium cylinder 15, this pivoting being brought about by means of a rocker bearing 16, on which the piston 17 of the pressure-medium cylinder 15 acts. The angle β through which the elbow lever 9 can be pivoted is relatively small; it is about 10°. The direction of movement in which the closure body 4 can be pivoted by means of the elbow lever 9 has a principal movement component 18 which is in the direction of the longitudinal axis 6 of the tapping hole 2.

A lever 19 acts on the rocker shaft 11 and can be moved by means of a further movement device, which is likewise designed as a pressure-medium cylinder 20, resulting in rotation of the rocker shaft 11 together with the elbow lever 9 and thus in a rocking movement of the closure body 4. The angle χ through which the rocker shaft 11 can be pivoted is greater than the angle β through which the elbow lever 9 can be pivoted. It covers approximately 50°. As a result, the closure body 4, which is oriented in a plane which is more or less perpendicular to the longitudinal axis 6 of the tapping hole 2, can be pivoted. The principal movement component 21 of the closure body 4 during rotation of the rocker shaft 11 extends approximately transversely with respect to the longitudinal axis 6 of the tapping hole 2.

Figure 4:
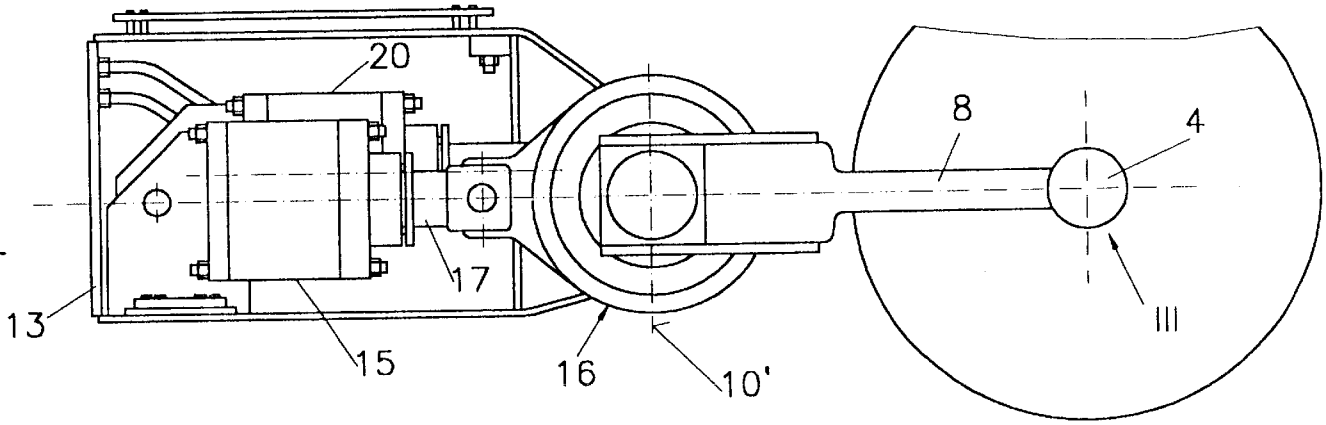
FIG. 4 shows a view similar to that of FIG. 3, with the closure body pivoted inwards and approximately in line with the longitudinal axis of the tapping hole.
Figure 3:
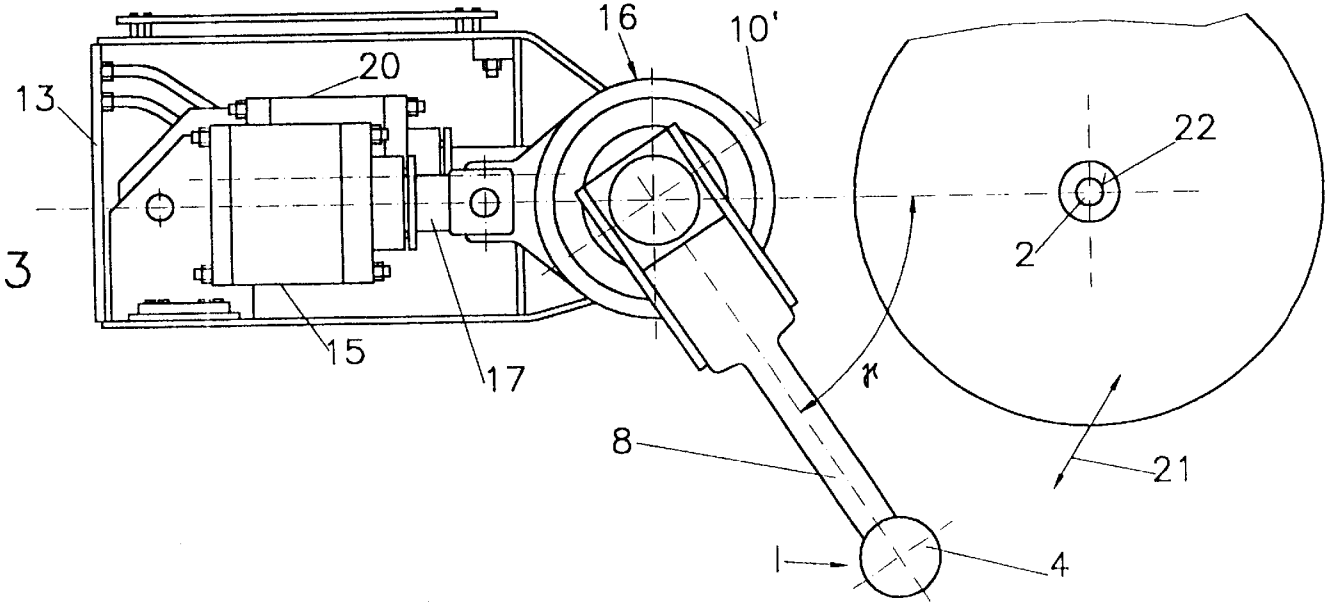
FIG. 3 shows a plan view of the tapping hole in the direction of the longitudinal axis of the tapping hole and shows the device according to the invention and the closure body pivoted laterally outwards.
Figure 5:
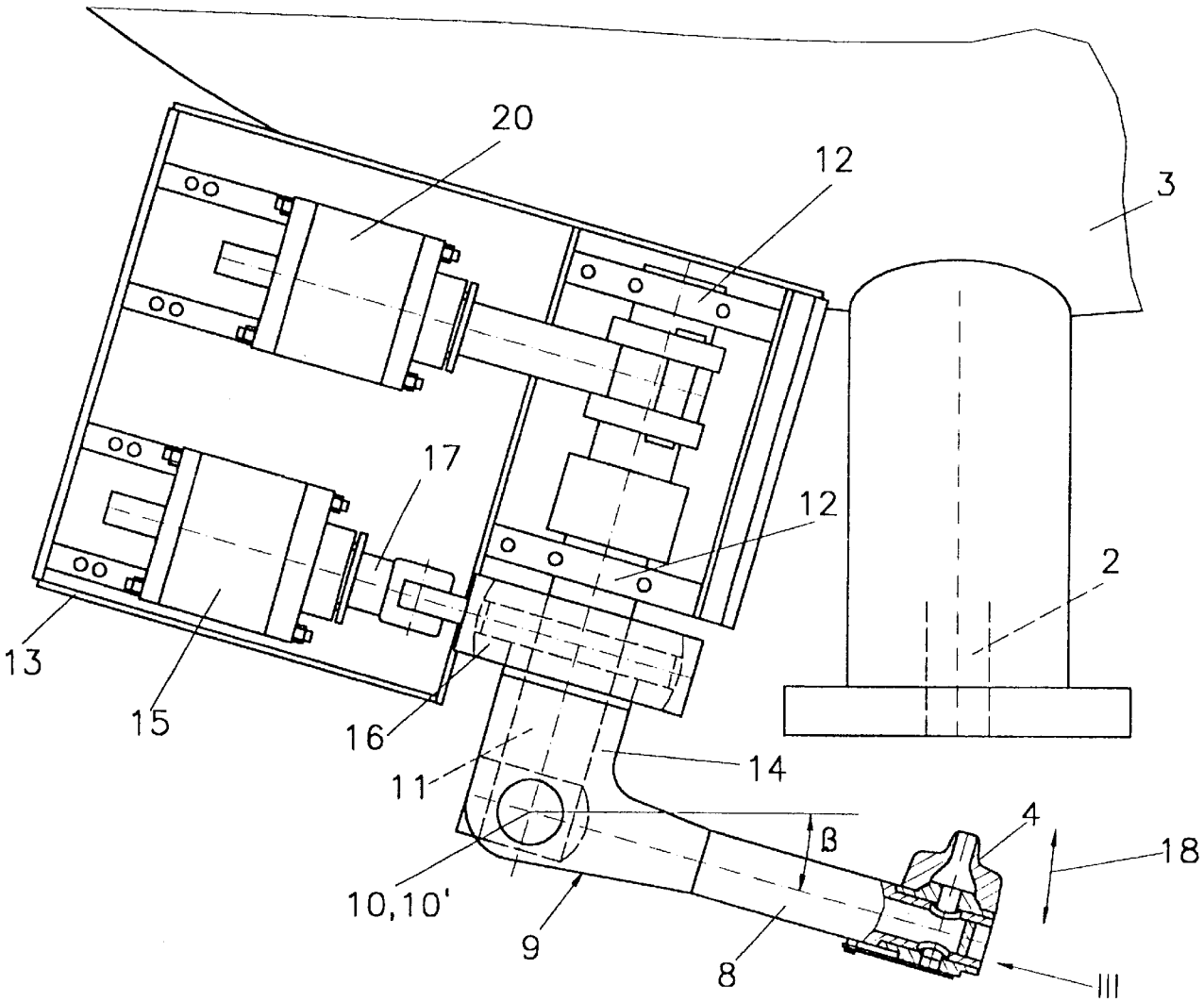
FIGS. 5 and 6 each show a side view, approximately at right angles to the longitudinal axis of the tapping hole, specifically in section, in one case (FIG. 6) in the closure position and in one case (FIG. 5) just before this position is reached.
Figure 6:
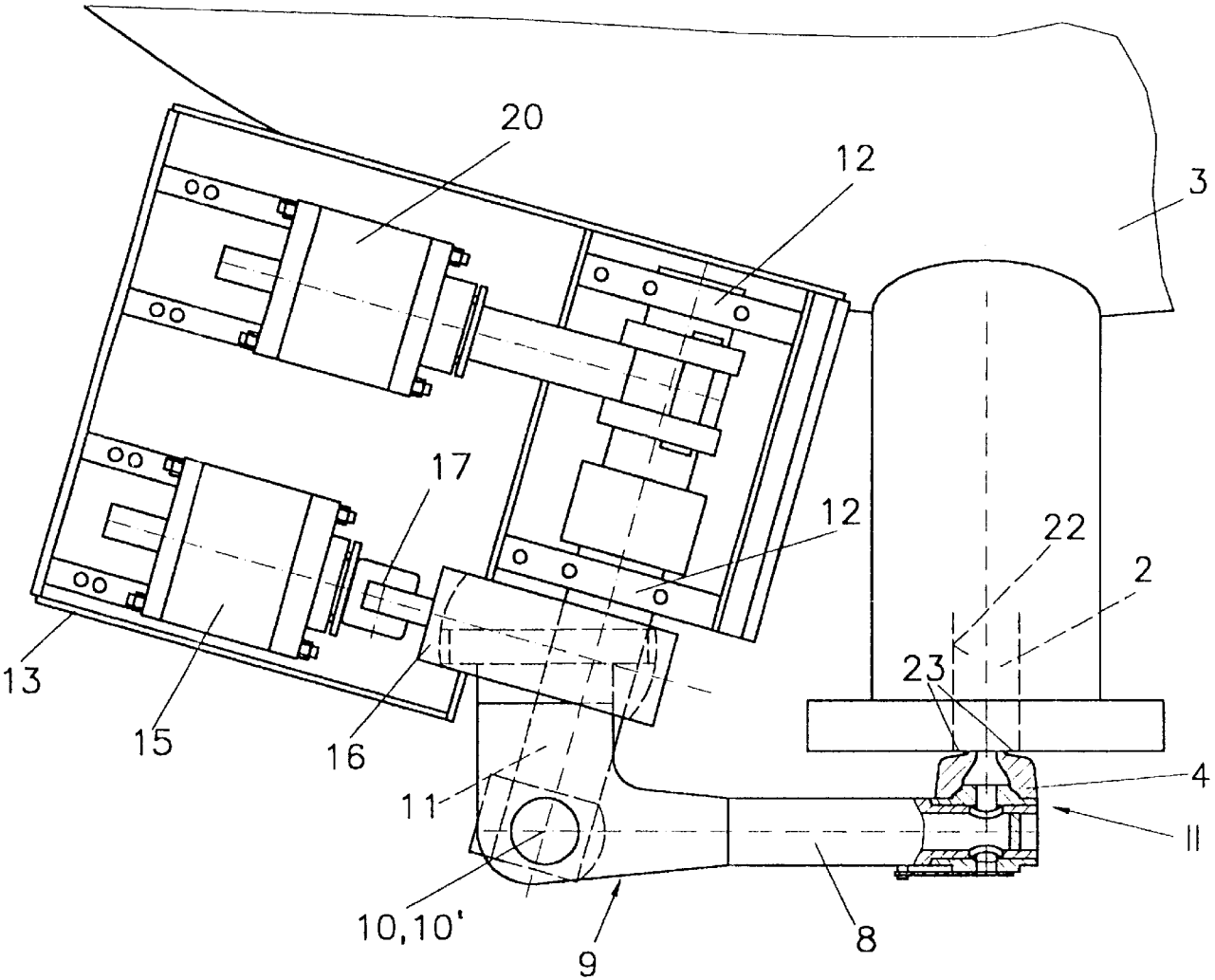

As can be seen in particular from FIGS. 5 and 6, it is possible, through simple pivoting of the elbow lever 9, to move the closure body 4 out of its closure position II, in which it penetrates into the tapping hole 2 and in which only an annular gap 23 for sucking in air is left clear between the closure body 4 and the wall 22 of the tapping hole 2, i.e. out of the closure position II, into an intermediate position III, which is illustrated in FIG. 5, in which the closure body 4 comes to lie entirely outside the tapping hole 2 just below the latter. This position is also illustrated in FIG. 4, which shows a plan view of the tapping hole 2. Then, through simple rocking of the elbow lever 9 about the rocker shaft 11, the closure body 4 is moved away laterally with a principal movement component 21 which is transverse with respect to the longitudinal axis 6 of the tapping hole 2, so that it reaches the waiting position I shown in FIG. 3.

Naturally, a combination of these two movements, i.e. the rotary movement of the rocker shaft 11 and the pivoting movement of the elbow lever 9, can also be achieved, in that initially the elbow lever 9 is pivoted at great speed and the rocker shaft 11 is rotated at only a lower speed, and this speed of the rotary movement of the rocker shaft 11 can then be increased, whereupon the pivoting movement of the elbow lever 9 is stopped.

The retaining medium (e.g. nitrogen) is advantageously introduced into the rocker pin 11 in the radial direction via a rotary slide valve. In this shaft, the nitrogen passes to a slide face and, from there, to the closure body 4 via the arm 8. The slide face (not shown in more detail) constitutes the connection between the rocker pin and the arm 8.

The invention can also be implemented in other ways, for example by bringing about the pivoting movements and rotary movements by means of guide control means or four-bar mechanism movement devices.

Figure 7:
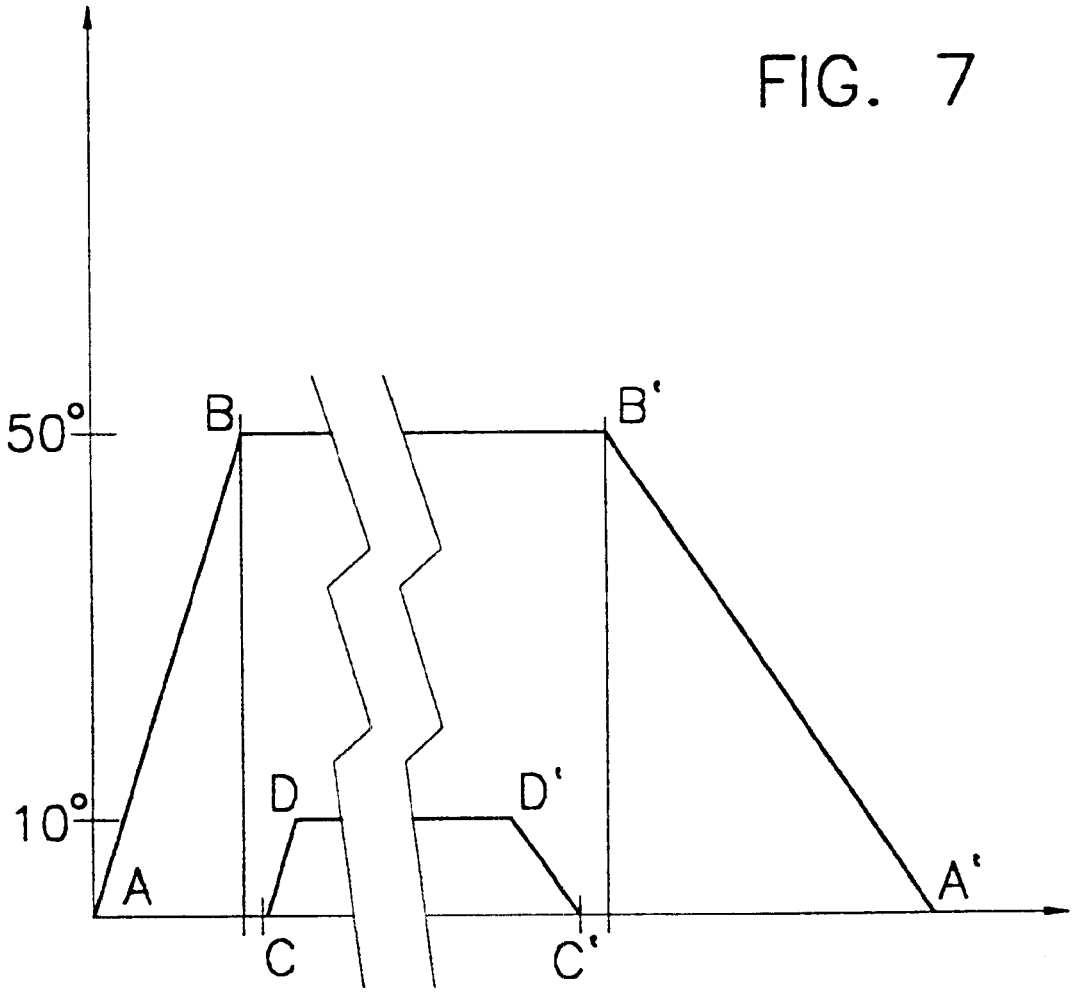
FIG. 7 diagrammatically depicts the movement of the closure body.

It can be seen from FIG. 7 that with the device according to the invention it is possible to achieve very short opening and closing times, which are of great importance in metallurgy terms. The pivoting and rotary movements of the rocker shaft 11 and the elbow lever 9, in degrees, are plotted on the ordinate. The abscissa shows the times which are required for the rotation of the rocker shaft 11 and pivoting of the elbow lever 9. The rocker shaft 11 is rotated from A to B, and the elbow lever 9 is pivoted from C to D, specifically for the purpose of closing the tapping hole 2. The closed position is maintained from D to D'. The elbow lever 9 is pivoted back from D' to C', and the rocker shaft 11 is rotated back from B' to A'; both during opening of the tapping hole 2. The points A and A' illustrate the waiting position I, the points D and D' illustrate the closure position II, and B and B' illustrate the intermediate position III of the closure body 4.

It can be seen from FIG. 7 that a short stationary period is planned between the rotary movement of the rocker shaft 11 and the pivoting movement of the elbow lever 9. This can also be avoided, or the pivoting of the elbow lever 9 may even be combined with the end of the rotary movement of the rocker shaft 11, as explained above, over a short period.

The essence of the invention is that, when the tapping hole 2 is opened, the closure body 4 is initially moved out of the tapping hole 2 in a first direction of movement with a principal movement component 18 which is directed approximately in the direction of the longitudinal axis 6 of the tapping hole 2, until it is just below the latter, whereupon it is moved away with a principal movement component 21 which is approximately transverse with respect to the longitudinal axis 6 of the tapping hole 2. Naturally, deviations from the principal movement directions 18 and 21, which during opening of the tapping hole initially lie in the longitudinal axis 6 of the tapping hole 2 and then transversely with respect to this axis, are possible (in the reverse order during closure of the tapping hole). The only essential factor is that the closure body 4 moves not only in one movement plane, as is the case in the prior art, i.e., for example, is pivoted only in a plane which lies through the longitudinal axis 6 of the tapping hole 2, but rather executes a three-dimensionally combined movement in different areas, which do not necessarily have to be planar.

What is claimed is:

1. A method for closing and opening a tapping hole of a metallurgical vessel, in which method a closure body, which leaves clear an annular gap between the closure body and the wall of the tapping hole can be moved out of a waiting position into a closure position, in which it covers the tapping hole and back, and in which method, at least in the closure position, a pressurized gas is introduced into the tapping hole counter to the outflow direction of a molten material contained in the metallurgical vessel, wherein the closure body is moved out of the waiting position into the closure position and back with directions of movement which lie in different areas, wherein the closure body, when it is being brought from the waiting position into the closure position, is first moved in a direction of movement which has a principal movement component which is approximately transverse with respect to the longitudinal axis of the tapping hole by at least partially turning the closure body around and towards the longitudinal axis of the tapping hole or inclined axis and, just before it reaches the closure position is moved—at least partially by a rotation, in a direction of movement which has a principal movement component which is approximately in the direction of the longitudinal axis of the tapping hole, and when it is being moved out of the closure position into the waiting position is first moved, again at least partially by a rotation, a short distance in a direction of movement with a principal movement component which is approximately in the direction of the longitudinal axis of the tapping hole and is then moved a longer distance in a direction of movement with a principal movement component which is approximately transverse with respect to the direction of the longitudinal axis of the tapping hole by at least partially turning the closure body around an towards the longitudinal axis of the tapping hole or inclined axis.

2. A method according to claim 1, wherein the direction of movement with a principal movement component, which is approximately in the direction of the longitudinal axis of the tapping hole, is implemented only over a very short distance.

3. A method according to claim 2, wherein said very short distance is a distance beyond which the closure body lies entirely outside the topping hole.

4. A method according to claim 1, wherein the movement with the principal movement component which is approximately transverse with respect to the longitudinal axis of the tapping hole is implemented over a significantly longer distance than the movement with the principal movement component which is in the direction of the longitudinal axis of the tapping hole.

5. A method according to claim 4, wherein said significantly longer distance than the movement of the principal component is at least five times as long.

6. A method according to claim 5, wherein said distance is at least ten times as long.

7. A device for closing a tapping hole of a metallurgical vessel in which device a closure body can be brought out of a waiting position into a closure position, in which it covers the tapping hole, and back, leaving clear an annular gap between the closure body and the wall of the tapping hole, by means of a movement device and in which device the closure body is provided with at least one pressurized-gas outlet, which is connected to a gas-supply line on its side which, in the closure position, faces towards the tapping hole, wherein, with the movement device for bringing the closure body out of the waiting position into the closure position, the closure body can be moved firstly in a direction of movement with a principal movement component which is approximately transverse with respect to the longitudinal axis of the tapping hole and then into the closure position with a principal movement component which is approximately in the direction of the longitudinal axis of the tapping hole and in the two movement devices are provided, one of which enables the closure body to move with the principal movement component which is approximately transverse to the direction of the longitudinal axis of the tapping hole and the further movement device enables the closure body to move with a principal movement component which is approximately in the direction of the longitudinal axis of the tapping hole and in that the movement devices provided are two pivoting devices, the closure body being mounted on an arm which can pivot in two planes which are approximately at right angles to one another.

8. A device according to claim 7, wherein the movement devices are formed by pressure-medium cylinders, which each act on the arm bearing the closure body by way of a system of levers.

9. A device according to claim 8, wherein the pressure-medium cylinders can be activated by means of only two control lines.

10. A device according to claim 9, wherein the closure body is arranged on an arm which projects from a pivot pin, which pivot pin is mounted pivotably on a rocker shaft which is directed approximately perpendicular thereto, the rocker shaft being mounted rotatably on a holding fixture arranged on the metallurgical vessel.

11. A device according to claim 10, wherein the rotary movement of the rocker shaft extends over approximately 40° to 60°, and the pivoting movement about the pivot pin extends over 5° to 15°.

12. A device according to claim 8, wherein the pressure-medium cylinder for executing a rotation of the rocker shaft acts, via a lever acting on the rocker shaft, and the pressure-medium cylinder for executing the pivoting movement about the pivot pin acts, via a radially projecting rocker bearing on one end of an arm of an elbow lever, the other arm of which bears the closure body.

13. A device according to claim 7, wherein the metallurgical vessel is a steelworks converter.

* * * * *